US008080117B1

(12) United States Patent
Lasko

(10) Patent No.: US 8,080,117 B1
(45) Date of Patent: Dec. 20, 2011

(54) ASPHALT ROOFING APPLIANCE

(76) Inventor: Bernard Lasko, Spartanburg, SC (US)

( * ) Notice: Subject to any disclaimer, the term of this patent is extended or adjusted under 35 U.S.C. 154(b) by 0 days.

(21) Appl. No.: 12/852,045

(22) Filed: Aug. 6, 2010

(51) Int. Cl.

| | |
|---|---|
| ***E04F 13/08*** | (2006.01) |
| ***B29C 65/32*** | (2006.01) |
| ***B29C 65/52*** | (2006.01) |
| ***B29C 65/02*** | (2006.01) |
| ***B32B 37/06*** | (2006.01) |
| ***B32B 37/12*** | (2006.01) |
| ***B32B 39/00*** | (2006.01) |
| ***B32B 43/00*** | (2006.01) |
| ***C09J 5/06*** | (2006.01) |

(52) U.S. Cl. ..... 156/71; 156/81; 156/155; 156/307.3; 156/309.6; 156/324; 156/379.6; 156/380.2; 156/391; 156/499

(58) Field of Classification Search ..... 156/71, 156/81, 83, 85, 155, 195, 305, 307.3, 308.2, 156/309.6, 324, 379.6, 380.2, 391, 499
See application file for complete search history.

(56) References Cited

U.S. PATENT DOCUMENTS

| | | | | |
|---|---|---|---|---|
| 2,273,599 | A * | 2/1942 | Smith et al. | 425/62 |
| 4,913,772 | A * | 4/1990 | Taylor et al. | 156/499 |
| 2008/0191391 | A1 * | 8/2008 | Lasko | 264/431 |

FOREIGN PATENT DOCUMENTS

DE 10306336 A1 * 8/2003

OTHER PUBLICATIONS

English Abstract of DE 10306336 A1.*

* cited by examiner

*Primary Examiner* — Sing P Chan

(57) ABSTRACT

Asphalt cylinders or thermoplastic polymer modified asphalt cylinders or particulate forms are induction melted by magnetic field susceptor for a controlled distribution with felt paper to accomplish the construction of an industry standard BUR roofing system. These forms are similarly melted for highway crack sealing in an additional embodiment of the invention.

10 Claims, 3 Drawing Sheets

ASPHALT ROOFING APPLIANCE

FIELD OF THE INVENTION

Induction heating of a steel susceptor is utilized to melt industry standard 100-pound cylinders of asphalt at the point of application. A face of the solid asphalt cylinder contacts a hot perforated steel susceptor and gravity flows to the roof surface. A wheeled supporting carriage is motor driven at a speed consistent with the surface distribution specification.

BACKGROUND OF THE INVENTION

Asphalt built up layer roofing (BUR) is primarily applied by moping 450° F. to 475° F. asphalt (petroleum distillate) or bitumen (naturally occurring coal tar) to a substrate and covering with felt paper in multiple layers. One hundred pound cylinders of material are broken with a sledge and shoveled into an under-fired gas or electric melting kettle. The surface of the vessel necessarily exceeds the target melt temperature of the thermally slow conducting material. This results in the liberation of odiferous and potentially carcinogenic smoke. The molten material is transported to the rooftop by heated pump and tubing to the application site and distributed with rag mops.

The current execution of this process is essentially the same as previously practiced for over 100 years. In recent years advances have been made in added smoke abatement equipment and material additives to coat the surface of the kettle melt.

The purpose of this invention is to replace the current apparatus and method of melting and distributing asphalt. The primary embodiment of the invention melts industry standard 100-pound cylinders of asphalt in a vertical orientation at the moving site of application. The asphalt is placed on a perforated metal disc that is magnetic induction heated to the target temperature. The material melts at this interface and is distributed to the substrate at a controlled rate, as the felt paper is unrolled to form a layer of the BUR roofing system. A wheeled carriage with a balancing pressure roller, of felt paper width, rides on the unrolling felt paper and disperses the asphalt melt flow. Continuously melting asphalt, high frequency induction heating power supply, rolled felt paper, and an electric motor to power the wheels are positioned on this carriage. The volume of asphalt melted is controlled to match the traverse speed of the unit. The hot asphalt flow can be stopped and restarted in seconds. An operator guides the unit and replenishes the felt paper and asphalt cylinder as required. The appliance is powered by flexible cable from a portable electric generator placed on the rooftop or at ground level as required by size.

This system provides the advantages of minimum exposure of melted material, controlled distribution, simultaneous application of the felt paper, avoids the smoke producing over heating, minimizes labor required and enhances job-site safety and energy efficiency.

A second embodiment of the invention is intended to address applications of rubberized asphalt and polymer asphalt blends that are placed to fill concrete highway expansion cracks and asphalt highway cracks, depressions for traffic control loops, and adhere highway reflective markers. Many of these compounds are currently distributed as briquettes to melt in hot oil heated tanks utilized to avoid local overheating. There would not be any economic disadvantage for material suppliers to package in cylinders to accommodate this superior method of melting. The same advantages of melt on demand, energy efficiency, safety and melt temperature control are present here.

DETAILED DESCRIPTION OF THE INVENTION

Figure 1:
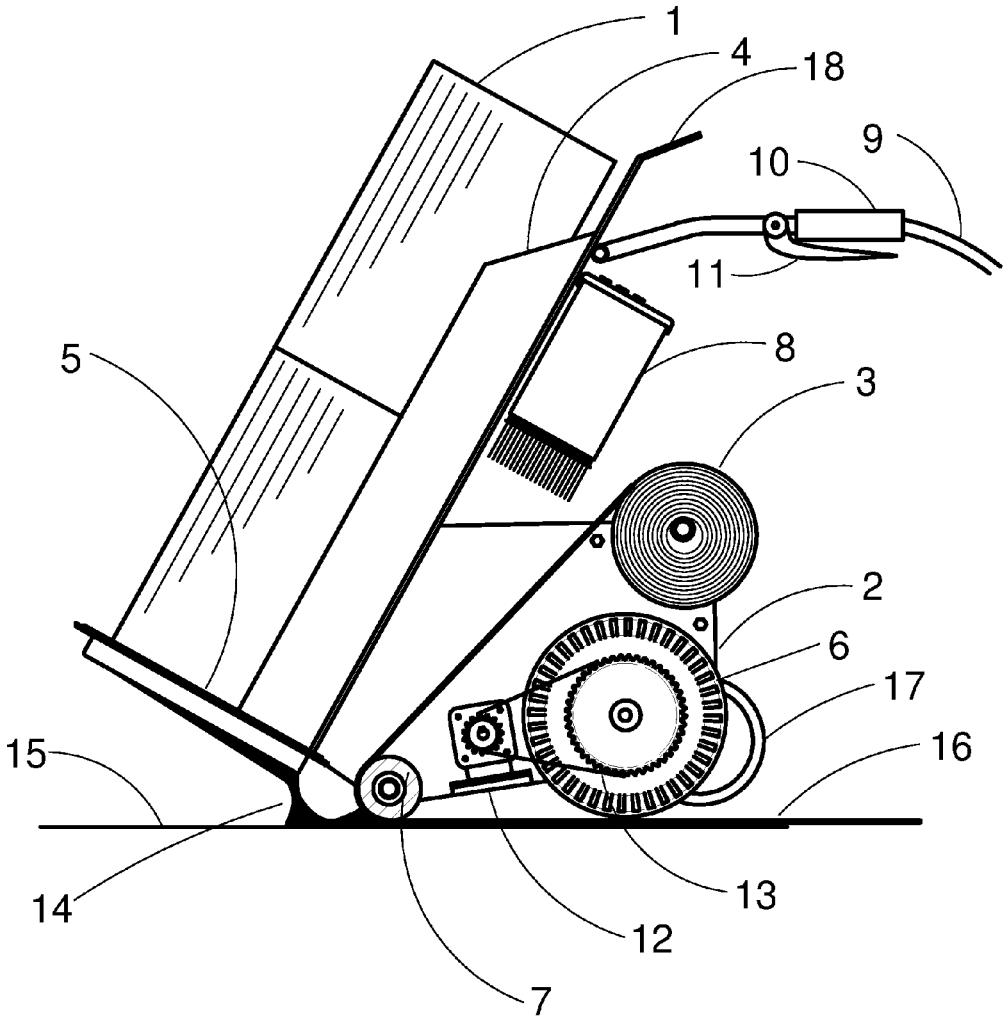
FIG. 1 is a partial cross section illustrating the major items included on the moving carriage.

FIG. 1 is a partial vertical cross section of an embodiment of the invention that illustrates a unit designed to distribute a 1/16" thick layer of 450° F. asphalt, as 39" wide felt paper is rolled out at 4 ft/min. Asphalt cylinders 1 are placed on carriage 2 with felt paper roll 3. All items on carriage 2 are contained within the width of the felt paper 3 plus the thickness of steel plate frame of carriage 2. Asphalt cylinders 1 rest on vee shaped slide 4 that is attached to carriage 2 at 15° from vertical to present the bottom face of asphalt cylinder 1 to heat susceptor assembly 5. In operation, the unit rests on pneumatic tire 6 and a leveling roll 7 that is slightly shorter than the felt paper 3 width. An air-cooled high frequency power supply 8 is powered by flexible cable 9 that enters through the carriage guide handle 10. Handle 10 also includes a grip switch 11 to assure that the unit is attended when the melt power and drive system are in operation. Electric motor 12 drives wheel 6 through a reduction sprocket and chain drive train 13. Melted hot asphalt 14 drops to the roof 15 at the center of roll 7 that is distributing roof felt 16.

Carriage 2 is rocked back to rest only on idle wheels 17 placed at the outer edges of carriage 2 to provide a rolling pivot of 180° for the laying of the succeeding layer. Lifting bail 18 at the top of the load support column is provided as a hoist attachment point to place the unit on a roof.

The apparatus can be constructed to be powered by a carriage 2 contained propane fuel cell delivering DC power to the high frequency power supply 8. The size and weight of fuel cells produced for forklifts are suitable for this application at an added cost. Enhanced portability and the availability of propane fuel make this option attractive.

Figure 2:
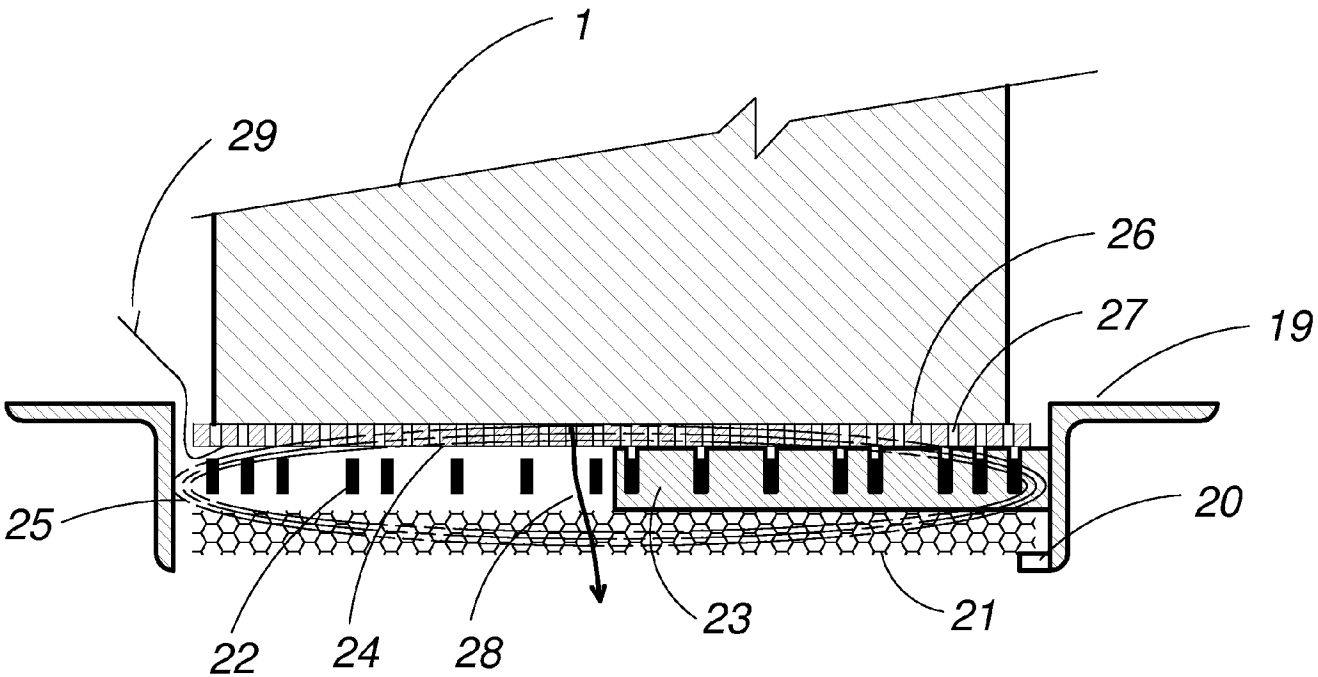
FIG. 2 is a cross section of the susceptors and inductor coil at the melt face.

FIG. 2 illustrates in vertical cross section the items that make up heat susceptor assembly 5. A rolled ring of aluminum angle 19 is attached to carriage 2 at the centerline of asphalt cylinder 1. The ring has radial edge tabs 20 to position secondary susceptor 21, inductor coil 22, radial coil positioning spacers 23, and primary susceptor 24. Heat susceptor assembly 5 can support two 100# cylinders of asphalt 1.

When high frequency power is applied to inductor coil 22, magnetic field 25 intercepts both primary susceptor 24 and secondary susceptor 21 in proportion consistent with the proximity and turns placement of inductor coil 22. The induced energy is evenly distributed by the fore mentioned means well known to those familiar with induction heating practice. Asphalt material in contact with susceptor face 26 melts and flows through perforations 27 as individual streams indicated by arrow 28. Melted asphalt gravity flows below the application target temperature specified by the roofing material producers. Hot asphalt material flows through inductor coil 22 absorbing electrical losses as described in Lasko U.S. Pat. No. 5,584,419. Additional heat is added to the flowing asphalt by secondary susceptor 21 to attain the commonly specified 450° application temperature. Primary susceptor 24 is constructed of 18 gage perforated steel sheet. Secondary susceptor 21 is Metpore FeCrAlY metal foam that is 0.500" thick. Thermocouple 29 provides the control signal to high frequency power supply 8 to modulate the power applied to hold the exit temperature at the specified application temperature. Power supply 8 provides power to inductor coil 22 at a frequency of 40 KHz to 100 KHz. Inductor coil 22 is constructed of 0.150"×0.050" bare rectangular motor winding copper.

Figure 3:
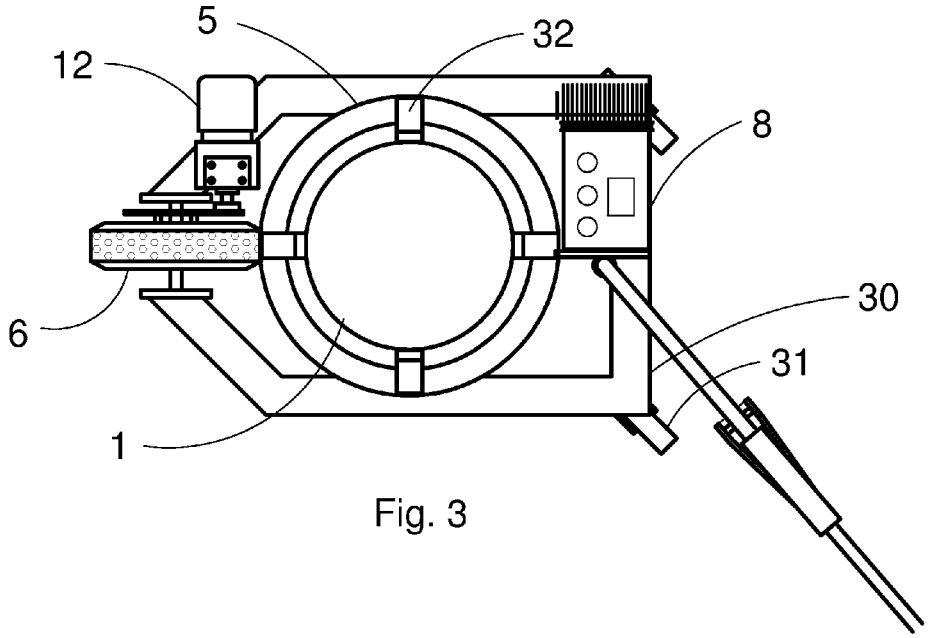
FIG. 3 is a top view of an apparatus styled for crack filling.
Figure 4:
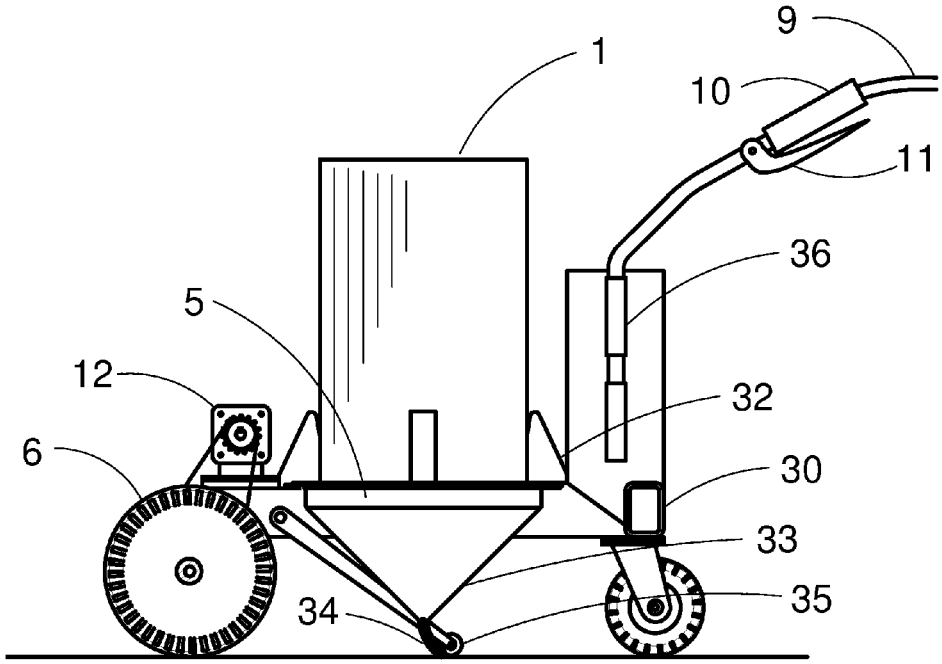
FIG. 4 is a partial cross section of an elevation of a unit styled for crack filling.

A second embodiment of the invention is illustrated in top view FIG. 3 and partial cross section FIG. 4 of a melting apparatus for crack filling. The same powered wheel 6, drive motor 12, high frequency power supply 8, and heat susceptor assembly 5 are assembled on a tri-wheeled tubular frame carriage 30 to melt the same size asphalt cylinder 1. Wheel 6 driven by motor 12 propels the unit at operator controlled variable speed. Trailing wheels 31 swivel for operator visual tracking of the crack.

Four Teflon guide blocks 32 position asphalt cylinder 1, for melting in assembly 5. The hot liquid is gathered in cone 33 formed of Teflon sheet to exit as stream 34 over a crack. Distribution roll 35 is added to level excess material. Handle 10 can be swiveled in pocket 36 and locked in place to guide the apparatus from various positions.

This apparatus attended by a pickup truck carrying a portable power generator, a cable boom, and supply of material can match the placement capacity of a propane fired, oil jacketed, crack filling melt trailer. Replacement of wheel 6 with a urethane tire face profiled to drop partially into a concrete expansion crack and locking the trailing swivel wheels can convert the apparatus into a dedicated expansion crack filler.

Both embodiments of the invention presented here can be sized to accommodate different diameter cylinders, material specific heat, and application temperature. Both embodiments of the invention can also process polymer modified asphalt or thermoplastic material particulate forms. Pelletized polymer materials or Trinidad Lake coated asphalt pellets can be processed in the same system with the addition of a Teflon cylinder sleeve acting as a pellet reservoir in the position of asphalt cylinder 1. Where duel component materials are to be applied the apparatus can be equipped with an inductor coil/susceptor arrangement as described in Lasko U.S. Pat. No. 7,755,009 for melting and mixing.

I claim:

1. An apparatus to melt and apply asphalt, consisting of the following:

a wheeled carriage to mount and distribute cylinders of asphalt and rolls of felt paper;

a high frequency powered inductor coil to heat a perforated susceptor in contact with a face of the asphalt cylinders to melt said asphalt cylinders;

a high frequency power supply to energize the inductor coil; and a source of electric power.

2. The apparatus according to claim 1 that includes a roller or rollers specifically designed to evenly distribute liquid asphalt.

3. The apparatus according to claim 1 that includes a set of idle wheels utilized to reposition the carriage.

4. The apparatus according to claim 1 that utilizes metal foam as the susceptor material.

5. The apparatus according to claim 1 that utilizes perforated steel sheet as the susceptor material.

6. A method of distributing cylinders of asphalt and rolls of felt paper that includes the steps of:

melting a face of an asphalt cylinder by contacting an induction heated perforated susceptor;

conveying the melting asphalt cylinder, unrolling felt paper and induction heating apparatus across a surface in a controlled motion; and powering said susceptor with a portable electric generator.

7. The method according to claim 6 that powers the unit with a fuel cell.

8. The method according to claim 6 that distributes the liquid asphalt with a roller pressuring the felt paper.

9. The method according to claim 6 that conveys the asphalt, felt paper and induction heating apparatus with an electric motor driven wheel.

10. A method of melting cylinders of thermoplastic material that includes the steps of;

melting a face of cylinders of thermoplastic material by contacting an induction heated perforated susceptor;

conveying said melting thermoplastic material and an induction heating apparatus across a surface in a controlled motion; and powering said susceptor with a portable electric generator.

* * * * *